US008217780B2

(12) United States Patent
Gilbert

(10) Patent No.: US 8,217,780 B2
(45) Date of Patent: Jul. 10, 2012

(54) SYSTEM AND METHOD FOR EXTENSION OF ENTRY DELAY IN A SECURITY SYSTEM

(75) Inventor: Kylie J. Gilbert, Concord (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 396 days.

(21) Appl. No.: 12/650,731

(22) Filed: Dec. 31, 2009

(65) Prior Publication Data

US 2011/0156904 A1 Jun. 30, 2011

(51) Int. Cl.
*G08B 23/00* (2006.01)

(52) U.S. Cl. ..... 340/527; 340/5.2; 340/5.3; 340/5.22; 340/5.28; 340/5.51; 340/4.35; 340/528; 340/529

(58) Field of Classification Search ..... 340/5.2, 340/5.22, 5.28, 5.3, 5.51, 4.3, 527–529
See application file for complete search history.

(56) References Cited

U.S. PATENT DOCUMENTS

| | | | | |
|---|---|---|---|---|
| 5,548,163 | A * | 8/1996 | French | 307/10.2 |
| 5,877,683 | A * | 3/1999 | Sheasley | 340/506 |
| 7,400,242 | B2 * | 7/2008 | Martin | 340/528 |
| 2006/0181408 | A1 * | 8/2006 | Martin | 340/528 |
| 2010/0245088 | A1 * | 9/2010 | Meier et al. | 340/545.1 |

* cited by examiner

*Primary Examiner* — Daniel Wu
*Assistant Examiner* — Son M Tang
(74) *Attorney, Agent, or Firm* — Kacvinsky Daisak PLLC

(57) ABSTRACT

A system and method are provided for extending the expiration of an entry delay period for disarming a security system based on the entry of a keypress that matches a valid access code before expiration of a preprogrammed entry delay period. The security system includes a plurality of detection devices to detect any number of conditions, a user interface such as a keypad, and a control panel communicating with each of the detection devices and the user interface. The system extends the entry delay period based on the input of each keypress using the user interface that matches a symbol of a valid access code.

14 Claims, 3 Drawing Sheets

SYSTEM AND METHOD FOR EXTENSION OF ENTRY DELAY IN A SECURITY SYSTEM

BACKGROUND OF THE INVENTION

1. Field of the Invention

Embodiments of the present disclosure relate to security alarm systems and associated methods for protecting residences, businesses and other premises. More particularly, the present disclosure relates to a system and method for extending the expiration of an entry delay period based on the entry of a keypress that matches a valid access code before expiration of a preprogrammed entry delay period.

2. Discussion of Related Art

Security or alarm systems are installed in premises to detect hazardous or potentially hazardous conditions. A security system generally includes a plurality of detectors/sensors, one or more keypads and a control panel which contains the system electronics and may include a communication interface for remote monitoring and two-way communication over telephone or wireless communication paths. Each of the detectors communicates with the control panel to provide notification of an alarm condition. Examples of possible alarm conditions include unauthorized entry or the unexpected presence of a person who may be an intruder, fire, smoke, toxic gas, high/low temperature conditions (e.g., freezing), flooding, power failure, etc. In other words, an alarm condition may represent any detectable condition that might lead to personal hazard or property damage. Audible and/or visible alarm devices such as sirens, lights, etc., may also be utilized to notify occupants of the existence of an alarm condition. The control panel may be located in a utility room, basement, etc., and may communicate with the detectors and notification devices by wired or wireless signal paths. A keypad, which may also communicate with the control panel via a wired or wireless connection, is used to arm/disarm the system as well as providing a means to display various system messages via a status display screen.

A typical security system includes an "exit delay" or "exit arming delay" process. An exit arming delay allows the end user sufficient time to exit the protected premises after arming the security system without triggering an alarm condition. Such a delay begins when the user arms the system using the keypad before exiting the premises. A user arms the system by entering a valid access code or by simply pressing one or more "special keys" which are preprogrammed function keys on the keypad. The exit delay period is programmed by the installer of the security system and is typically between 30 and 120 seconds in duration, but may be shorter or longer depending on the desired program.

Security systems also include an "entry delay" period program. This is the amount of time a user has to disarm the system once an entry detector has been triggered when the system has been previously armed. The system is disarmed by entry of a valid access or PIN code via the keypad. The entry delay is also typically programmed by the installer of the security system and can be, for example, between 30 and 60 seconds ("entry delay period"). In certain systems, the control panel examines keystrokes entered by a user in blocks where the size of the block corresponds to the number of symbols in the access code. Thus, if the access code comprises four (4) digits, the control panel analyzes the first four keypresses to see if they match the access code. If they match, the system is disarmed. If they do not match, then the control panel examines the next four keypresses (i.e. keypresses 5 through 8) to determine if they match the valid access code. Only a certain number of keypress attempts are allowed before the system locks the keypad and/or the entry delay period terminates resulting in an alarm condition.

In current systems, the entry delay period is fixed such that a user must disarm the system by completing entry of the access code before expiration of the entry delay period. If a user begins to enter the access code before expiration of the entry delay period, but, doesn't complete entry of the access code until after expiration of the entry delay period, then an alarm condition will be processed locally by the control panel, and depending on how the security system is programmed, sent to a central monitoring facility.

In certain instances, the user may have only been distracted from completing entry of the access code before expiration of the entry delay period. For example, if an entry delay period is programmed for 30 seconds and the valid access code requires four (4) digits, a user must complete entry of all four keypresses corresponding to the four digits of the valid access code before expiration of the 30 second entry delay period otherwise an alarm condition results. However, if a user correctly enters the first two (2) of the four digits of the valid access code before expiration of the 30 second entry delay period, but does not enter the last two digits before expiration of the entry delay period, an alarm condition results. In this situation, the alarm condition would be considered a false alarm since it resulted from a user's inability to enter the access code during the allotted entry delay period. Certain municipalities charge residents for false alarms since it unnecessarily occupies police resources. Thus, it is an object of the present disclosure to provide an entry delay extension period to avoid unnecessary false alarms.

SUMMARY OF THE INVENTION

Exemplary embodiments of the present disclosure are directed to a process for extending the entry delay period of a security system. In an exemplary embodiment, such a method includes receiving a keypress from a security keypad and determining if the keypress was received within an entry delay period. A determination is made whether of not the received keypress matches a first symbol contained in a valid access code. If the keypress was entered within the entry delay period and the keypress matches a first symbol of the valid access code, extending the entry delay period by a predetermined time interval for entering the security access code.

In another exemplary embodiment, a security system for protecting a premises includes at least one detection device for monitoring a portion of the premises, a control panel that communicates with the at least one detection device, and a user interface that communicates with the control panel. The user interface is configured to allow a user to enter one or more keypresses corresponding to a valid access code having a plurality of symbols which arms and disarms the security system. The control panel is configured to extend an entry disarming delay period to allow the user to enter the one or more keypresses based on at least one of the keypresses matching a first of the plurality of symbols of the valid access code.

DESCRIPTION OF EMBODIMENTS

Figure 1:
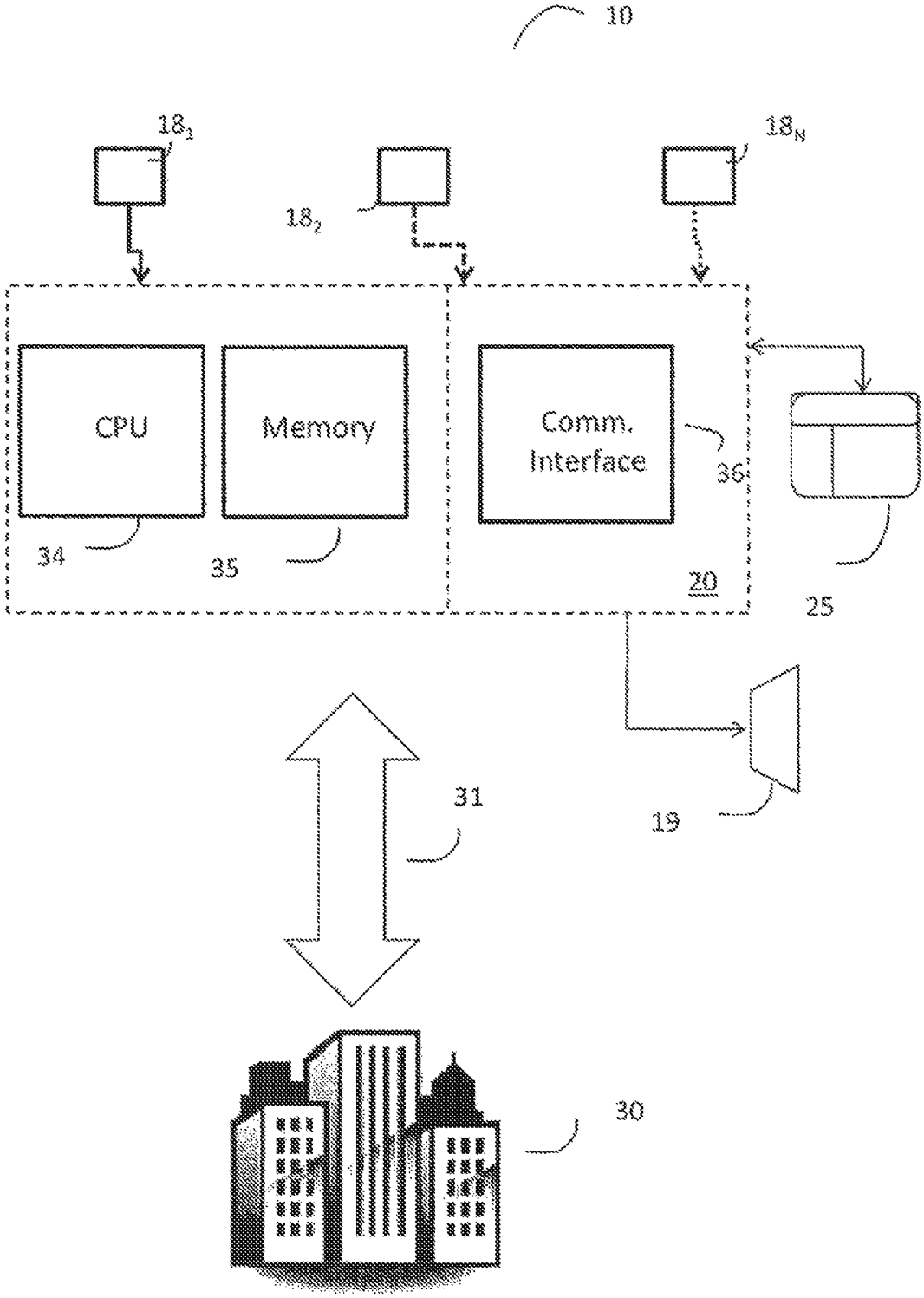
FIG. 1 illustrates a block diagram of an exemplary security system in accordance with an embodiment of the present disclosure.

The present disclosure will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a block diagram of a typical security system 10 embodying the present disclosure installed in a building or premises. Security system 10 includes a control panel 20 which generally controls operation of the system. A number of detection devices $\mathbf{18}_1 \ldots \mathbf{18}_N$ are utilized to monitor an area. Detection devices may include, for example, motion detectors, door contacts, glass break detectors, smoke detectors, water leakage detectors, etc. Detection devices $\mathbf{18}_1 \ldots \mathbf{18}_N$ communicate with panel 20 by a wired interconnect 18A, wirelessly 18B, through the electric wiring of the premises 18C, or otherwise. One or more user interfaces, such as keypad 25 is used to communicate with control panel 20 to arm, disarm, notify and generally control system 10. The alarm system 10 may further include other notification devices such as sirens, emergency lights, etc., referenced generally as 19.

Control panel 20 communicates with each of the detection devices $\mathbf{18}_1 \ldots \mathbf{18}_N$, keypad 25 and notification devices 19 as well as communicating with a monitoring facility 30 which is typically geographically remote from the premises in which system 10 is installed. Control panel 20 may include a CPU 34, memory 35 and communicator 36. CPU 34 functions as a controller to control the various communication protocols within system 10. Memory 35 stores system parameters, detection device information, address information etc. Communicator 36 sends and receives signals to/from the monitoring facility 30 via communications link 31. Alternatively, communicator 36 may be a separate device that communicates with controller 20 via a hardwired or wireless connection.

When an alarm condition occurs based on the operation of one or more detection devices $\mathbf{18}_1 \ldots \mathbf{18}_N$, a signal is transmitted from the respective detection device to control panel 20. Depending on the type of signal received from the one or more detection devices, communicator 36 communicates with monitoring facility 30 via link 31 to notify the monitoring facility that an alarm notification has occurred at the premises. Communication link 31 may be a POTS (Plain Old Telephone System), a broadband connection (e.g., internet), a cellular link such as GSM (Global System for Mobile communications) transmission, etc. In certain security systems, keypad 25, control panel 20 and communicator 36 may be housed within a single unit.

As noted above, keypad 25 is used to communicate with control panel 20 to arm, disarm, notify and generally control system 10. Keypad 25 includes a status display which may include either individual indicators, such as discrete light emitting diodes or may include an LCD or LED display, capable of displaying messages regarding the status of particular detection devices $\mathbf{18}_1 \ldots \mathbf{18}_N$ and/or operation of the system.

Each security system is given at least one unique access code (sometimes referred to as a PIN), which is generally a sequence of symbols (e.g. numbers, letters, characters, etc.) entered via keypad 25 used to arm and, disarm system 10. When arming system 10, a user enters their access code and an exit delay time is provided before the detection devices $\mathbf{18}_1 \ldots \mathbf{18}_N$ are activated so that a user may exit the premises before system 10 becomes armed. Conversely, upon entering the premises, the user enters the access code to disarm the system 10. An entry delay time period is programmed into the system 10 to allow the user to enter the access code before the system goes into alarm mode.

In particular, when a person enters the premises, the associated detection device, typically one or more door contacts (e.g. $\mathbf{18}_N$), is activated which transmits a signal to control panel 20. Keypad 25 or other notification device 19 which is usually located near an entry/exit door provides warning beeps to notify the entering person to disarm system 10. Control panel 20 provides an entry delay period for the person entering the premises to enter an access code to disarm the system. The duration of this entry delay period is stored in memory 35 and may range from 30 seconds to more than a minute. However, in certain situations, a user is unable to enter the entire access code to disarm the system prior to expiration of the entry delay period. This is disadvantageous when, for example, a user enters the premises in the middle of the night and does not enter the access code within the entry delay period triggering an audible alarm that can be heard by neighbors. In addition, by not entering the access code within the entry delay period, an alarm notification may be sent to the monitoring facility resulting in a false alarm.

Figure 2:
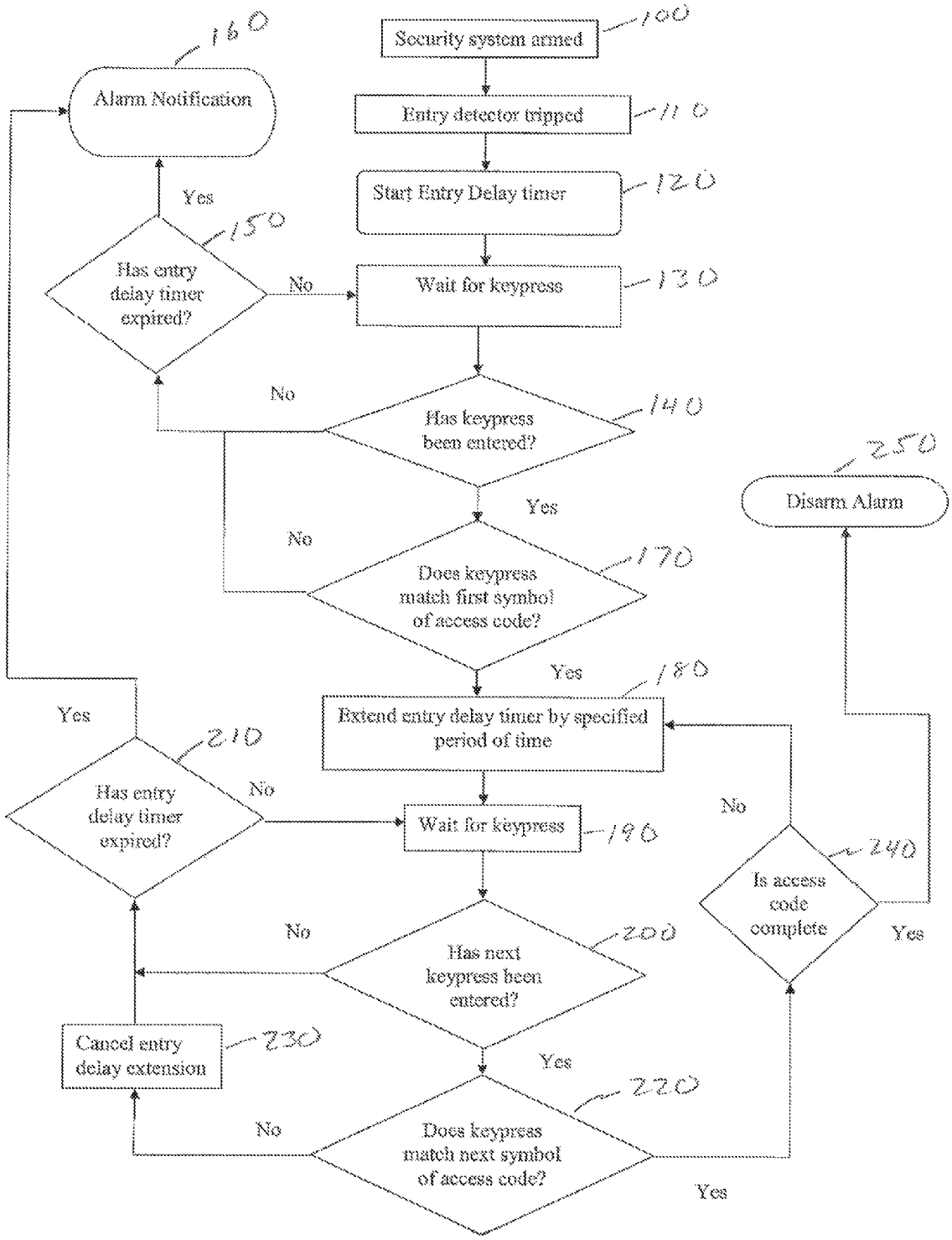
FIG. 2 is a flow chart of an exemplary entry delay extension process utilizing the security system of FIG. 1 in accordance with an embodiment of the present, disclosure.

FIG. 2 is a flow chart illustrating the operation of security system 10 utilizing the entry delay extension method in accordance with an embodiment of the present disclosure. Again, the entry delay period may be 30-120 seconds and is initiated once the premises is entered where the security system was previously armed at step 100. This entry triggers one or more of the detectors at step 110 associated with the particular entry zone (e.g. door). The entry delay period begins at step 120 which allows a user to enter a valid access code before sending an alarm condition either locally and/or to remote monitoring facility 30. An access code typically comprises four (4) symbols entered via keypad 25, although access codes of fewer or greater symbols may also be employed. These symbols may be, for example, numbers, letters, characters and/or combinations thereof. Once the entry delay period begins, the system waits for the user to enter a keypress at step 130.

A determination is made at step 140 whether or not a keypress has been entered via keypad 25. If a keypress has not been entered, a determination is made at step 150 whether or not the entry delay period expired. If the entry delay period has expired, then an alarm notification is processed at step 160. If the entry delay period did not expire, the system returns to step 130 and awaits a keypress via keypad 25. Once a user enters a keypress, a determination is made at step 170 whether or not the keypress matches a first symbol of the valid access code associated with the system 10. If the entered keypress does not match a first symbol of the valid access code, the process returns to step 150 to determine if the entry delay timer expired. If the entry delay timer did not expire, the system returns to step 130 and awaits a keypress. In addition, the system may be programmed to enable keypad "lockout" where after a certain number of incorrect entries, a user cannot enter another keypress. This is done to avoid random entry attempts.

If the entered keypress matches a first symbol of the valid access code at step 170, the entry delay period is extended by a specified amount of time such as, for example, ten (10) seconds at step 180. By way of example, if the entry delay period was preprogrammed into system 10 to be thirty (30) seconds, and a user enters a keypress which matches a first symbol of the valid access code, the entry delay period will be extended by ten (10) seconds making the entry delay period a total of forty (40) seconds.

Once the entry delay period is extended at step 180, the process waits for the next keypress at step 190. A determination is made at step 200 if the next keypress has been entered via keypad 25. If the next keypress has not been entered, a determination is made at step 210 whether of not the entry delay time period, including the extension provided at step 180, has expired. If this entry delay time period has expired, an alarm notification is sent at step 160. If the entry delay time period did not expire, the process returns to step 190 and waits for the next user keypress.

If the next keypress has been entered at step 200, a determination is made whether or not the keypress matches the next symbol of the access code at step 220. If the keypress does not match the next symbol of the valid access code, then the entry delay extension provided in step 180 is cancelled at step 230 and a determination is made at step 210 whether or not the original entry delay timer (i.e. minus the delay extension) expired. If the entry delay timer expired, an alarm notification is sent at step 160.

If the keypress does match the next symbol of the valid access code, a determination is made at step 240 if each symbol of the access code has been entered. The process continues N-1 number of times where N is the number of symbols contained in the valid access code. Thus, if there are four (4) symbols in the valid access code, the entry delay period may be extended for three separate time intervals. If there are six (6) symbols in the valid access code, the entry delay period may be extended for five (5) separate time intervals. If the access code is complete, the system is disarmed at step 250. If the access code is not complete, an extension of the entry delay time period is added at step 180.

Again by way of example, if the entry delay period was preprogrammed into system 10 to be thirty (30) seconds, and a user enters a keypress which matches a first symbol of the valid access code at step 170, the entry delay period will be extended by ten (10) seconds at step 180 making the entry delay period a total of forty (40) seconds. If a user enters sequentially, after the first symbol of the access code is matched, another keypress that matches the second symbol of the access code, then the entry delay period may be extended by an additional ten (10) seconds making the entry delay period a total of fifty (50) seconds. It should be noted that the keypresses which match the valid access code must do so sequentially. Of course, each entry delay extension may be programmed to be the same period of time (e.g. ten (10) seconds), or may be more or less with each keypress that matches the next symbol of a valid access code. In this manner, the entry delay period provided for a user to enter a security system access code may be extended with each and/or after a certain number of keypresses that match the valid access code. By extending the time allotted for a user to disarm a security system based on the entry of valid keypresses, false alarms both locally and at a central monitoring station are avoided.

The process described herein may be automated by, for example, tangibly embodying a program of instructions in memory capable of being read by a machine which executes these instructions. The CPU 34 is one example of such a machine. The functions and process steps herein may be performed automatically or wholly or partially in response to user commands. A step performed automatically is performed in response to one or more executable instructions or device operations without user initiation of the activity.

Figure 3:
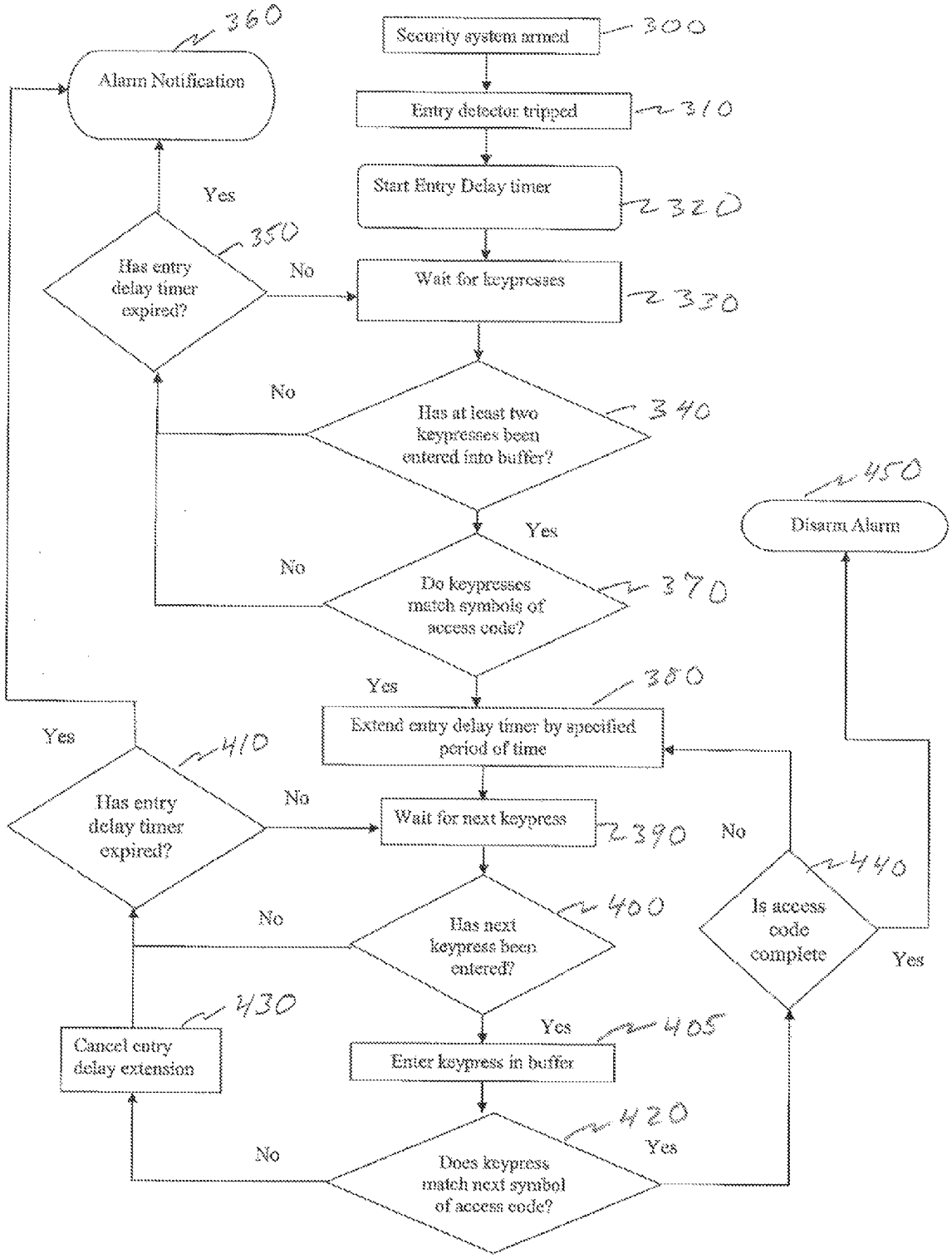
FIG. 3 is a flow chart of an exemplary entry delay extension process utilizing the security system of FIG. 1 in accordance with an embodiment of the present disclosure.

FIG. 3 is a flow chart illustrating the operation of security system 10 utilizing a rotating keypress buffer and the entry delay extension method in accordance with the present disclosure. A rotating buffer compares each keypress entered by a user against a valid access code on a rotating basis. With each additional keypress in excess of the size of the buffer, the first entry stored in the buffer is cleared. Each keypress stored in the buffer is compared with corresponding symbols of the valid access code as will be described in more detail below.

Once the premises is entered where the security system was previously armed at step 300, an entry detector associated with the particular entry zone is tripped at step 310. The entry delay period begins at step 320 and waits at step 330 for a user to enter a valid access code before sending an alarm condition either locally (e.g. an audible alarm) and/or to remote monitoring facility 30. If a keypress has not been entered, a determination is made at step 350 whether or not the entry delay period expired. If the entry delay period has expired, then an alarm notification is processed at step 360. The alarm notification may be a local audible alarm using, for example, a siren and/or may be a notification to a central monitoring facility. If the entry delay period did not expire, the system returns to step 330 and awaits a keypress via keypad 25.

A determination is made at step 340 whether or not at least two (2) keypresses have been entered via keypad 25. The two keypresses are stored in the rotating buffer. When at least two (2) entries are stored in the buffer, they are compared (using, e.g. CPU 34) to the first two symbols of the valid access code. The buffer operates pursuant to the first in, first out principle such that when an additional entry is made that exceeds the buffer space, the first entry stored in the buffer is pushed out making room for the most recent inputted entry. For example, when a valid access code contains four (4) symbols, the buffer is programmed to have a corresponding length of four (4) symbols. Each keypress stores an entry in a corresponding location of the buffer. When a fifth keypress is made, the first entry in the buffer is pushed out and the fifth entry is stored in the buffer.

Once a user enters at least two (2) keypresses, a determination is made at step 370 whether or not the keypresses match a first and second symbol of the valid access code. If the entered keypresses do not match the first two symbols of the valid access code, the process returns to step 350 to determine if the entry delay timer expired. If the entry delay timer did not expire, the system returns to step 330 and awaits the next keypress. When a third keypress is entered, a determination is again made at step 340 whether the last two (2) keypresses entered match the first two symbols of the access code. In particular, if three keypresses have been entered by a user, but the first keypress does not match the first symbol of the valid access code, the rotating keypress buffer matches the second and third entered keypresses to see if it matches the first and second symbols of the access code. This is done assuming that the first and second keypresses did not consecutively match the first and second symbols of the access code.

If the last two keypresses match a first and second symbol of the valid access code at step 370, the entry delay period is extended by a specified amount of time such as, for example, ten (10) seconds at step 380. Once the entry delay period is extended at step 280, the process waits for the next keypress at step 390. A determination is made at step 400 if the next keypress has been entered via keypad 25. If the next keypress has not been entered, a determination is made at step 410 whether or not the entry delay time period, including the extension provided at step 380, has expired. If this entry delay time period has expired, an alarm notification is processed at step 360. If the entry delay time period did not expire, the process returns to step 390 and waits for the next user keypress.

If the next keypress has been entered at step 400, the keypress is stored in the rotating keypress buffer at step 405 and the'contents of the buffer are compared to the access code at step 420. If the contents of the buffer do not match the corresponding symbols of the valid access code, then the entry delay extension provided in step 380 is cancelled at step 430 and a determination is made at step 410 whether or not the original entry delay timer (i.e. minus the delay extension) expired.

If the entry delay timer expired, an alarm notification is sent at step 360. This process continues N-2 number of times where N is the number of symbols contained in the valid access code. Thus, if there are four (4) symbols in the valid access code, the entry delay period may be extended twice since the first extension determination is made after two keypresses have been entered. If, for example, there are six (6) symbols in the valid access code, the entry delay period may be extended for four (4) separate time intervals. If the keypresses do match the corresponding symbols of the valid access code, a determination is made at step 440 if all the symbols of the access code have been entered. If the access code is complete, the system is disarmed at step 450. If the access code is not complete, an extension of the entry delay time period is added at step 380.

Similar to the process described above with respect to FIG. 2, each entry delay extension may be programmed to be the same duration of time (e.g. ten (10) seconds), or may be more or less with each keypress that matches the next symbol of a valid access code. In this manner, the entry delay period provided for a user to enter a security system access code may be extended with each and/or after a certain number of keypresses that match the valid access code. The presently disclosed process of extending the time allotted for a user to disarm a security system based on the entry of valid keypresses, false alarms may be avoided.

While the present invention has been disclosed with reference to certain embodiments, numerous modifications, alterations and changes to the described embodiments are possible without departing from the sphere and scope of the present disclosure, as defined in the appended claims. Accordingly, it is intended that the present invention not be limited to the described embodiments, but that it has the full scope defined by the language of the following claims, and equivalents thereof.

What is claimed is:

1. A method for examining a security access code, the method comprising:

receiving a keypress from a security keypad;

determining if the keypress was received within an entry delay period;

determining if the keypress matches a first symbol of a valid access code;

if the keypress was received within the entry delay period and the keypress matches the first symbol of the valid access code, extending the entry delay period by a predetermined time interval for receiving the security access code.

2. The method for examining a security access code of claim 1 wherein said keypress is a first keypress, said valid access codes includes a plurality of symbols and the step of extending the entry delay period by a predetermined time interval for receiving the security access code is a first delay extension, said method further comprising:

receiving a second keypress sequentially after said first keypress into a security keypad;

determining if the second keypress matches a second symbol of said valid access code;

if the second keypress does not match a next symbol of the plurality of symbols of the valid access code, cancelling said entry delay period extension, and if the second keypress matches the next symbol of the plurality of symbols of the valid access code, extending the entry delay period by a second predetermined time interval for receiving the security access code.

3. The method for examining a security access code of claim 2 further comprising triggering an alarm notification via said security system when said second keypress does not match said second symbol of said preprogrammed security access code.

4. The method of examining a security access code of claim 3 wherein triggering said alarm notification comprises sending the alarm notification to a device configured to sound an audible alarm.

5. The method of examining a security access code of claim 3 wherein triggering said alarm notification comprises sending the alarm notification to a remote monitoring service.

6. The method of examining a security access code of claim 2 wherein the first entry delay extension time interval has the same duration as the second entry delay extension time interval.

7. The method of examining a security access code of claim 2 wherein the first entry delay extension time interval has a different duration than the second entry delay extension time interval.

8. The method of examining a security access code of claim 1 wherein said valid access code is preprogrammed and associated with the security system.

9. A security system for protecting a premises comprising:

at least one detection device for monitoring a portion of the premises;

a control panel configured to communicate with said at least one detection device; and a user interface communicating with the control panel, said user interface configured to allow a user to enter one or more keypresses corresponding to a valid access code having a plurality of symbols which arms and disarms the security system, said control panel configured to extend an entry disarming delay period to allow the user to enter said one or more keypresses based on at least one of said keypresses matching a first of said plurality of symbols of said valid access code.

10. The security system of claim 9 wherein said entry disarming delay period is programmable.

11. The security system of claim 9 wherein said extension of said entry disarming delay period is a preset time interval programmed into said control panel.

12. The security system of claim 11 wherein said preset time interval is initiated up to N-1 times where N is the number of symbols contained in the valid access code.

13. The security system of claim 9 wherein said control panel includes a microprocessor.

14. The security system of claim 13 wherein said control panel includes a memory configured to communicate with said microprocessor.

* * * * *